United States Patent [19]

Röhrich

[11] 4,122,967

[45] Oct. 31, 1978

[54] VACUUM-TIGHT WINDOW STRUCTURE FOR THE PASSAGE OF X-RAYS AND SIMILAR PENETRATING RADIATION

[75] Inventor: Heinz Röhrich, Erlangen, Germany

[73] Assignee: Siemens Aktiengesellschaft, Berlin & Munich, Germany

[21] Appl. No.: 756,472

[22] Filed: Jan. 3, 1977

[30] Foreign Application Priority Data

Feb. 11, 1976 [DE] Fed. Rep. of Germany ..... 2605376

[51] Int. Cl.[2] ..... H01J 35/18

[52] U.S. Cl. ..... 220/2.3 R; 313/59; 313/420

[58] Field of Search ..... 220/2.1 A, 2.3 A, 2.3 R; 313/55–60, 420, 478–482; 250/213 VT, 505, 506, 526

[56] References Cited

U.S. PATENT DOCUMENTS

| | | | |
|---|---|---|---|
| 2,187,125 | 1/1940 | Kern et al. | 313/420 |
| 2,730,637 | 1/1956 | Atlee | 313/420 X |
| 2,820,168 | 1/1958 | Stiff | 313/420 |
| 2,885,585 | 5/1959 | Zunick et al. | 313/420 |
| 2,898,492 | 8/1959 | Miller | 313/420 X |
| 3,105,916 | 10/1963 | Marker et al. | 313/420 X |
| 3,406,304 | 10/1968 | Brewster | 313/420 |
| 3,716,737 | 2/1973 | Belkin et al. | 313/59 |
| 3,878,417 | 4/1975 | Eberlein | 313/59 |

FOREIGN PATENT DOCUMENTS

| | | | |
|---|---|---|---|
| 618,811 | 7/1947 | United Kingdom | 313/420 |
| 829,695 | 3/1960 | United Kingdom | 313/59 |
| 1,103,563 | 2/1968 | United Kingdom | 250/505 |

*Primary Examiner*—Stephen Marcus
*Attorney, Agent, or Firm*—Hill, Gross, Simpson, Van Santen, Steadman, Chiara & Simpson

[57] ABSTRACT

A window structure having a vacuum-tight seal provided by a pressure fit between a tubular frame section and a tubular window flange section both having their edges directed toward the exterior side of the window structure. A further ring is disclosed as being press fit at the inner side of the window flange section, the frame section having a smaller thermal coefficient of expansion than the window flange section and being disclosed as having a circumferential bead interlocked with a receiving groove in the window flange section of radial dimension such that the window member can be removed from the frame section by heating the frame section to a high temperature while applying a cooling fluid to the material of the window flange section. The coefficients of thermal expansion of the tubular frame section and of the inner ring are such that the gap formed between these two sections remains approximately the same or is reduced during heating, while the window flange section having a greater thermal coefficient of expansion, is pressed with very high pressure against the interior surface of the frame section during heating about its entire circumference simultaneously and uniformly, so that thermal or mechanical forces occur uniformly with no risk of distortion or warpage. Interiorly of the mechanical seal the window structure is entirely free of agents such as solder or adhesive which are a souce of contaminating gas molecules and would shorten the useful life of the tube.

10 Claims, 3 Drawing Figures

VACUUM-TIGHT WINDOW STRUCTURE FOR THE PASSAGE OF X-RAYS AND SIMILAR PENETRATING RADIATION

BACKGROUND OF THE INVENTION

The invention relates to window structures for the passage of X-rays and similar penetrating radiation and is in the nature of an improvement to the pending commonly assigned application U.S. Ser. No. 669,725 filed Mar. 23, 1976.

Window structures for penetrating radiation are known for X-ray tubes, where the high vacuum envelope contains a source of radiation which is to be transmitted by the window structure to the exterior of the envelope with as little loss as possible. Window structures are also known for permitting the entry of external radiation into the interior of a high vacuum envelope, that is so called inlet windows, and such window structures are used in connection with tubes for converting X-ray energy, or similar penetrating radiation of isotopes, such as gamma rays, into signals for the purpose of registration (for example for display and/or recording of a radiation image). Such tubes must be particularly vacuum-tight and free of gas molecules if conversion into electrons takes place within the tube, or if the converting elements, such as for example, photoelectric cathodes containing alkaline metals, are sensitive to atmospheric influences. Tubes of this type may contain, for example, measuring probes for producing electrical measuring signals, or they may contain arrangements which are suitable for converting the radiation into optical or electrical signals, from which a visible image may be obtained. Such tubes are known, for example, as picture-forming or image-converting tubes, television tubes, etc.

In the known tubes, metal windows which permit X-rays, gamma rays, etc., to pass through, frequently consist of beryllium (Be) which is quite permeable to the rays. The beryllium window plates are here soldered or welded to the housing of the tube by interposing connecting elements (compare U.S. Pat. No. 3,419,741 and British patent specification No. 978,878). However, in the present state of the art, beryllium window plates are not available in the desired range of sizes. Moreover, beryllium is capable of being shaped only with great difficulty. In many applications of X-ray windows, for example, for use in X-ray image intensifiers, a large diameter and freedom of shaping limitations are required in addition to the availability of a moderately priced material. Consequently the inlet windows in vacuum image intensifiers are at the present time still manufactured from glass, although this material absorbs X-rays to a substantial extent even when of the minimum thickness required for mechanical strength.

Thin foils consisting of titanium have also already been proposed as radiation-permeable windows (compare U.S. Pat. No. 3,878,417). The problem of securing thin foils is here solved by setting the metal foil in a stable frame which may be made of steel rings, for example. For the purpose of a vacuum-tight seal, the circumferential edge of the foil is welded to the adjoining surfaces of the rings. However, if a window structure for a vacuum tube is formed in such a way, the thin foil is forced inwardly into the interior of the tube by virtue of external atmospheric pressure, and consequently the tube must be of greater overall length than is required in a conventional image intensifier with an outwardly curved glass window.

Tubes consisting entirely of aluminum, that is of a light metal (of less than 4.5 grams per centimeter cubed) (4.5 g/cm$^3$), have also not been proven successful. Up to the present time, no way has been found for maintaining a vacuum-tight seal about the necessary lead-in wires which would be acceptable in practical applications.

It is also known to weld shaped disks of light metal into a heavy metal frame so that windows even with a large diameter and of any desired shape can be obtained in an economical and simple manner (compare U.S. Ser. No. 607,874 filed Aug. 26, 1975). Plates of light metal other than beryllium are used here, and a layer of the light metal is fused with a layer of a heavy metal by rolling under high pressure. The heavy metal layer is then tightly welded to the frame. This is carried out, according to one embodiment, in such a manner that the edge of the window, which is bent outwardly to form an axial flange, is fitted into a ring-shaped frame, the edges of the window flange and frame being subsequently welded together.

In studying the present problem, it has been shown that it could be advantageous if, in securing the windows, it would be possible to dispense with the type of heating which is required in a conventional welding or soldering operation. For example, by not using any additional agents such as solder or adhesive, it would be possible to definitely prevent fluxing agents, or bonding and hardening agents, respectively, from later giving off gas molecules detrimental to the high vacuum condition which should be maintained within the tube.

SUMMARY OF THE INVENTION

It is an object of the invention to provide an improved construction of radiolucent window in which disks or plates of the above cited type, particularly those with a large diameter, are secured in a vacuum-tight fashion without welding, and in such a way that they can also be detached again in a simple manner.

This problem is solved in accordance with the invention by providing the window member with an axially outwardly directed window flange section of tubular configuration in vacuum-tight press fit relation with an encompassing tubular frame section having a lesser coefficient of thermal expansion, an interior ring section being inserted in press fit relation to the interior side of the window flange section.

In the solution provided in the copending application Ser. No. 669,725 filed Mar. 23, 1976, the connection of the window member with the frame involves three tubular sections pressed into one another, one such section being the tubular edge of the window overlying and engaging a free edge of the frame, and the third section being an additional ring overlying the tubular section of the window member, the materials of the sections being selected such that the thermal coefficient of expansion of the outer section is smaller than that of the material of the window tubular edge, and the thermal coefficient of expansion of the frame section generally corresponding to that of the outer ring section.

By means of the present improved window structure it is possible in accordance with the invention for the connection of the window with the frame to be separable again in a simple fashion. The window member is provided with a turned out edge section or flange section which is directed generally axially of the window structure and toward the exterior side thereof. The end edge of the window flange is situated outside of the vacuum and sealed therefrom by means of the vacuum-tight mechanical seal between the window flange and the frame section. In order to release the mechanical interlock between the window member and the encompassing frame section, a cooling fluid may be filled into the annular space at the exterior side of the cup-like window member (with the exterior side of the window structure directed upwardly) and heat applied to the radially outer frame section so as to expand the frame section and free the mechanical interlock thereof with the window section. Suitable tool receiving apertures may be provided between the inner ring member and the window member so as to facilitate axial retraction of the window member and inner ring member from the frame member.

In accordance with the invention, it is possible to manufacture inlet windows, for example, in the form of caps of inexpensive materials, such as aluminum or its alloys, for example, although beryllium and its alloys may also be used. On the other hand, other materials, such as synthetics, for example polyimides, may also be used, if they sufficiently permit the passing through of penetrating radiation while being sufficiently stable to support a high vacuum at the interior side thereof. Materials of this type are known to be conventional construction materials and are therefore available in random sizes and may be shaped in any desired manner. Window structures can therefore also be obtained having an approximately segmental spherical or other desired curved (or domed) shape, so that it is possible to achieve adequate mechanical strength with good radiolucent properties.

In accordance with the invention it is, in addition, possible to attain the advantages offered by a heavy metal frame (that is a frame made of metal with a density equal to or greater than 4.5 grams per cubic centimeter) which can form the transition to a glass or heavy metal tube. However, the tube may also consist entirely of a metal such as iron, steel, nickel, copper, etc. What is of major importance is that the selected material for the tube be stable in a high vacuum and that it permit the manufacture of a tube of sufficient mechanical strength. Both the material used for the tube and those used for the window structure must satisfy one common requirement; namely, a guaranteed vacuum-tight fit of the parts when they are pressed together and, if necessary, heated to increase the mechanical pressure therebetween.

Pursuant to the invention, it is possible to dispense with welding or soldering. This results in the desired advantage that the deformations of the frame, etc., are prevented as otherwise may occur in the conventional methods of welding or soldering with localized heating. On the contrary, the invention provides that all sections of the frame and the window are simultaneously engaged with one another during assembly, so that thermal or mechanical forces occur uniformly on all sections, and there is no risk of distortions or warpage.

What is of essential importance in the invention is that the gap between the inner and outer tubular sections remain approximately constant or be reduced during heating. Into such gap a window flange section is placed having a coefficient of thermal expansion greater than that of the external section. What is achieved thereby is that, during heating, the window flange section having the greater thermal coefficient of expansion is pressed outwardly under very high pressure against the encompassing frame section. Since the gap between the inner and outer sections has an essentially constant radial dimension while the radial dimension of the window flange section tends to increase in thickness (as well as diameter), it is apparent that the pressure between the three tubular sections is increased with increasing temperature so as to provide an extremely tight mechanical fit therebetween. To achieve this result for three tubular sections, the outer tubular section must be of superior mechanical rigidity, and the inner section must have a thermal coefficient of expansion which at least corresponds to that of the external section, although it may lie below the thermal coefficient of expansion of the central window flange section. A tight connection between these sections is thereby achieved without requiring any soldering or adhesive agents. In addition to the metals explicitly described above, all other materials may also be used which, when tightly pressed together, result in a sufficiently stable mechanical sealing engagement for the purpose of the present invention. In addition to metals, the interfitting sections may also be composed of ceramic or other materials which are metal-coated on the surface. On the other hand, synthetic materials may also be used which result in a vacuum-tight connection under mechanical contact pressure.

In a known solder, adhesive, or similar connection of parts having different thermal coefficients of expansion and interfitting with one another (for example parts of metal and/or ceramic material), difficulties arise particularly in the case of brazing of metal and ceramic parts with diameters in excess of 30 mm which are to be avoided by surrounding the part having the greater expansion coefficient with a band consisting of a mechanically stronger (thicker) material having a smaller thermal coefficient of expansion, or by having a likewise mechanically stronger (thicker) part which is not interrupted along its circumference, but with a greater thermal coefficient of expansion being fitted against the internally disposed section. Preferably, the expansion coefficient of the additional section is to be approximately equal to that of the ceramic material, in order that a press fit between the parts is guaranteed also during the soldering process. However, these connections require a bonding agent, for example a soldering or adhesive agent, etc. According to present day knowledge, however, such joined parts are not suitable for the high vacuum tubes employed in cathode ray technology because the soldering agents or also the adhesive agents give off gas for a long time when exposed to a vacuum.

In one embodiment of the invention, a vacuum-tight window structure is obtained which is well permeable to X-ray and gamma radiation, in an image intensifier, for example, by manufacturing the inlet side of the vacuum tube for the image intensifier, or the entire tube, from steel, and by providing that the inlet window consist of an aluminum cap which fits into the inlet aperture of the image intensifier. Moreover, a steel ring is prepared which is composed of the same material as the tube, the ring fitting externally about the edge of the cap, and a steel ring is also prepared which is of such a type that it fits internally into the tubular, turned-out edge of the window. In accordance with the invention, when the parts are interjoined, a tight, firm fit of the cap within the outer ring is obtained, if the internal ring, together with the window cap member, is kept cold, and if the external ring is heated. In this manner, the external ring, which is to serve as a frame member, can be tightly placed about the window member, so that the entire assembly can then be inserted at the inlet side of the tube and secured according to the known welding process. Moreover, because of the out-turned flange of the window member, it is possible, for example, (with the window member in an upright position) to pour in a cooling fluid into the annular space provided by the cap-like window member so as to maintain the window member and inner ring at a relatively low temperature while heating the external ring or frame member so as to permit removal of the window member from the frame.

When using steel and aluminum, the ratio of the coefficients of thermal expansion of these two materials can be expressed as a ratio of one to two. However, special steels may also be used with which different expansion conditions can be achieved. With high grade steel, for example, ratios also of one to one can be achieved. For tubes having an inlet diameter of 30 cm and more, it is expedient to use high grade steel for the tube wall. Sufficient strength is obtained if the wall thickness is about 2 mm, and the diameter from 30 to 40 cm. In this arrangement, the thickness of the aluminum windows sufficiently stable at 1 mm, with a sufficient permeability to penetrating rays. A steel ring having a thickness of 2 mm provides sufficient support to the external circumference. In addition, the caps should have a flange of a length from about 2–3 cm along the edge of the tube inlet, and the ring serving as the frame member should have a width in the range from about 3 to about 5 cm. By selecting the dimensions as cited above, good stability is achieved and also sufficient contact area between the parts.

An improvement in the seal can be achieved if one or more circumferential beads or the like are provided on the interior surface of the exterior section of the frame, on the surface against which the window flange section of the window engages, such bead or beads or the like extending parallel to the exterior edge of the window structure. When the parts are joined together, the bead or beads are pressed into the material of the window member and in this fashion improve the seal. As a rule, a single bead should be sufficient. The profile of the bead can have a triangular or quadrilateral shape viewed in radial transverse section. However, other shapes are also certainly usable, such as semicircular, for example. What is important is only that a tight connection must be formed pursuant to pressing of the bead into the material of the window flange section.

Other objects, features and advantages of the invention will be apparent from the following detailed description of the illustrative embodiments taken in connection with the accompanying drawing.

BRIEF DESCRIPTION OF THE DRAWINGS

In FIG. 1, reference numeral 1 designates a vacuum-tight tube having a window structure at its inlet end comprising a window member 2 composed of aluminum. Behind window 2, there is disposed a carrier 3 composed of aluminum, which is provided with a fluorescent coating 4 and a photocathode layer 5. This combination, which is to be characterized as a photocathode, is followed by electrodes 6, 7, 8 and 9, and a luminescent screen 10 which is sensitive to electrons. The luminescence screen 10, in turn, is disposed in front of an optically transparent window 11 which is transparent to visible light and represents the closure of the opposite end of the tube 1, such closure being disposed opposite to the window structure at the inlet end of the tube 1. As is known, electrodes 6 through 9 serve the purpose of forming an image on the luminescence screen 10 of the electrons released at the photocathode 3–5. For this purpose, electrodes 6 through 9 are connected via feed lines 12 through 16 to a voltage source for producing the respective operating potentials for these electrodes.

Figure 2:
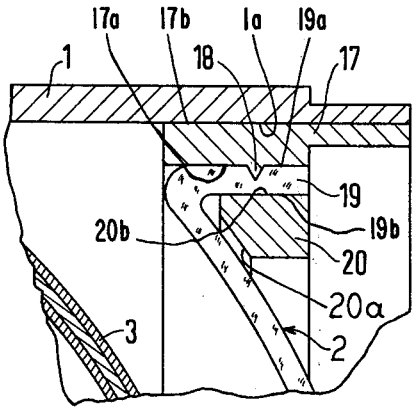
FIG. 2 is an enlarged partial longitudinal sectional view showing details of the window structure at the inlet end of the image intensifier.

It is apparent from FIG. 2 that the cap-shaped inlet window member 2 consisting of aluminum with a thickness of 2 mm has the shape of a cap whose edge is turned out and extends axially toward the exterior side of the window structure. A ring 17 is placed about the exterior of the window 2 and serves as a frame member. The frame member or section 17 is made of the same steel as tube 1. Moreover, near its outer edge at the interior side thereof, ring 17 is provided with a bead 18 exhibiting a triangular shape in cross section, so that a vacuum-tight fit results upon compression. The special stability results from the fact that there is a strong steel ring 20 disposed on the interior side of the turned-out window flange section 19, which inner ring section 20 is shown as having a greater radial thickness than the outer frame section 17, the thicknesses of each of the parts being uniform about their circumference in the illustrated embodiment. Through the use of aluminum for window member 2, and steel for the frame section or ring 17 and for the inner ring 20, a vacuum-tight clamping of window member 2 is obtained in accordance with the invention.

Figure 1:
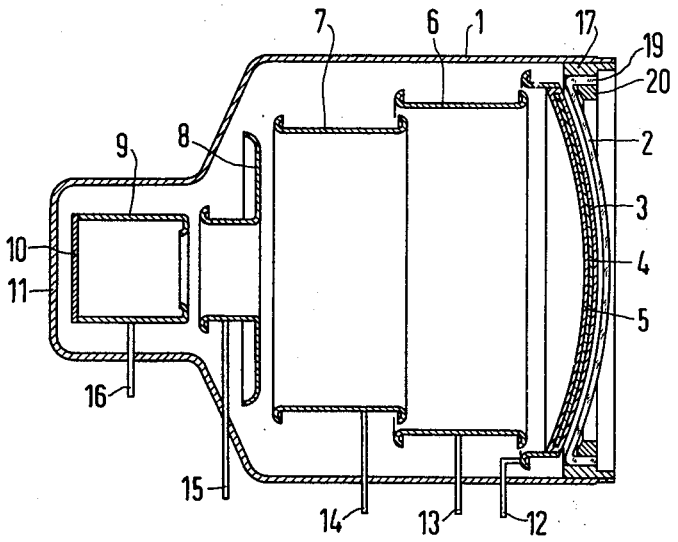
FIG. 1 is a general diagram of a vacuum X-ray image intensifier shown in longitudinal section and provided with a window structure in accordance with the present invention.
Figure 3:
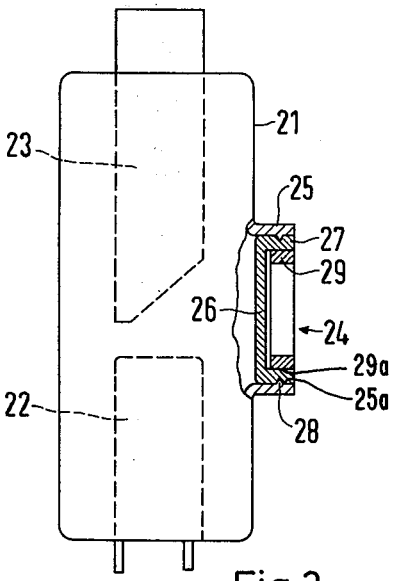
FIG. 3 is a diagrammatic elevational view of an X-ray tube apparatus and showing a window structure therefor in accordance with a second embodiment of the present invention and illustrating the case where the frame section is simultaneously a part of the tube wall.

The X-ray tube illustrated in FIG. 3 comprises a vacuum tube 21, corresponding to the tube 1 of the image intensifier according to FIGS. 1 and 2. In the vacuum tube 21, an anode 23 is arranged opposite a cathode 22. The significant difference in comparison with an image intensifier consists in that, in the tube of FIG. 3, X-rays are generated on the cathode 23 which are to be used outside the tube 21. In order to facilitate the exit of the rays, a window structure 24 is allocated to the anode 23. This window structure has a frame section 25 introduced into the wall of the envelope 21 as a tubular protuberance. In such frame section 25, a 1 mm thick aluminum plate or disk 26 is inserted having a cup-shaped out-turned edge which forms a tubular window flange section 27 resting against the interior side of the tubular frame section 25. A circumferential bead 28 with a triangular cross section is here also impressed into the material of the window flange section 27 to improve the seal, as in the embodiment according to FIGS. 1 and 2. Inner ring 29 fits against the interior side of the window flange section 27, and corresponds to the ring 20 in FIGS. 1 and 2. In this embodiment of window structure 24, it is possible to dispense with an additional ring such as 17 in FIGS. 1 and 2, serving as the frame section. Here, the tubular protuberant section of the wall of envelope 21 itself is used as the frame section.

As previously explained, in securing the window flange section with the outer tubular frame section (such as indicated at 17 in FIG. 2 and at 25 in FIG. 3) it is possible to dispense with welding or soldering so that soldering agents and also adhesive agents which give off gas over a long time period when exposed to a vacuum are eliminated or excluded from access to the vacuum by the vacuum-tight mechanical seal between the frame section and the window flange section. Further, the parts are assembled and secured simultaneously so that thermal or mechanical forces occur uniformly on all sections, and there is no risk of distortions or warpage. In each of the embodiments, a gap is formed between a radially inner annular surface 17*a* or 25*a* of the frame section 17 or 25 and a radially outer annular surface 20*b* or 29*a* of the inner ring section (20 or 29) which remains approximately of the same radial extent or is reduced during heating of these parts. Into this gap, the window flange section 19 or 27 is inserted which is of material such as aluminum having a coefficient of thermal expansion which is greater than that of the outer frame section. Accordingly, during heating, the window flange section 19 or 27 is pressed under very high pressure against the confronting walls or annular surfaces of the flange section 17 or 25 and the inner ring section 20 or 29. A tight connection of these sections is thereby achieved without requiring any soldering or adhesive agents.

In the embodiment according to FIGS. 1 and 2, a vacuum-tight window structure of an image intensifier is provided wherein the entire tube at the inlet end may be made of steel with an inlet diameter of 30 cm. Where the tube 1 is made of a high grade steel having a coefficient of thermal expansion approximately equal to the coefficient of expansion of the material of the window member 2, the frame section 17 may be of a steel having a substantially lower coefficient of thermal expansion than the window member 2, for example such that the ratio of the coefficient of thermal expansion of the frame section 17 to the material of the window flange member 19 may be about two to one. The material of the frame section 17 is, of course, continuous about the circumference of the window flange member 19 and is of a thickness so as to have a strength exceeding that of the material of the window member and such as to confine the window member under high pressure within the gap between the frame section 17 and the inner ring 20 during heating. Where the material of the tube 1 has a higher coefficient of thermal expansion than the frame section 17, the parts 17, 19 and 20 should be at a low temperature while the tube end is at a high temperature during assembly of the window structure so that a tight joint is maintained between the frame section 17 and the tube end 1 over the range of operating temperatures of the image intensifier.

Where the bead 18 is preformed on the frame section 17 prior to assembly thereof with the window flange member 19, the radial extent of the bead 18 may be correlated with the available differential expansion between the window flange member 19 and the frame section 17 when a suitable cooling fluid is poured into the annular recess formed by the cap configuration of the window member 19 and the frame section 17 is heated to a maximum feasible temperature. Thus, if the internal ring 20 together with the window material 2 is kept cold, and the external frame section 17 is heated, the frame section 17 can be assembled over the other two members, and then the bead 18 forced into the softer material of the window flange section 19 as the frame section 17 returns to room temperature. By the reverse process, once the frame section 17 has been assembled within the end of the tube 1 as shown in FIG. 2, the cooling fluid can be poured into the annular recess provided by the cap-like configuration of the window member 2 (arranged in an upright orientation), and heat applied to the frame section 17 so as to enable removal of the window member 2 and inner ring 20 from the inlet end of the tube 1. The inner ring 20 may be bevelled as indicated at 20*a* and spaced from the adjoining outwardly curved surface of the window section of the window member 2 so as to provide a gripping surface engageable with a tool to facilitate removal of the window member 2 from the end of the tube 1.

For tubes 1 having an inlet diameter of 30 cm or more, sufficient strength is obtained if the wall thickness of the tube 1 prior to the reduction in thickness as shown in FIG. 2 is about 2 mm, and if the thickness then further reduces to a thickness of about 1 mm. In this arrangement, the thickness of the window member 2 at the window section thereof may be 1 mm, and provide a sufficient permeability to penetrating rays. The outer frame member 17 may have a thickness of 2 mm, with a reduction to a thickness of 1 mm outwardly of the end edge of the window flange 19. The window flange member 19 at its radially outer annular surface 19*a* may engage with the frame section 17 over an extent of from 2–3 cm, and the external surface or radially inner annular surface 176 of the frame member 17 may engage with the inner surface or radially inner annular surface 1*a* of the tube 1 over an extent of from 3–5 cm.

In each of the embodiments, the interior ring section 20 or 29 may be provided with an exterior surface of a conical shape and of progressively increasing diameter in the direction toward the exterior of the window structure, and similarly, the frame section 17 or 25 may be provided with an interior surface of a corresponding conical shape and with a progressively increasing diameter in the direction toward the exterior of the window structure.

In forming the window structure of FIGS. 1 and 2, or FIG. 3, the parts may be assembled one over the other and pressed together and then heated up to 400°–500° C to ensure a vacuum-type mechanical sealing fit between the frame section 17 or 25 and the window flange section 19 or 27. To facilitate description of the present invention, surfaces 19*a* and 19*b* are described as the "radially outer" and "radially inner" surfaces of the window flange 19, so as to distinguish these surfaces as being outer and inner with respect to the radial direction extending from the center of curvature of the annular flange 19 radially outwardly. The term "encircle" is used in the sense of being radially outwardly of and encompassing. Thus ring 20, FIG. 2, is encircled by both the flange 19 and the tubular frame section 17, and the ring 29, FIG. 3, is encircled by both the flange 27 and the tubular frame section 25.

It will be apparent that many other modifications and variations may be effected without departing from the scope of the novel concepts of the present invention.

I claim as my invention:

1. A vacuum-tight window structure for the passage of X-ray energy and similar penetrating radiation, said structure comprising a frame having a tubular frame section with an edge directed generally axially toward the exterior side of the window construction, the tubular frame section extending generally axially and having a radially inner annular surface directed radially inwardly, a window member having a central disc-shaped window section transparent to penetrating radiation and having a tubular window flange section extending generally axially and providing radially inner and radially outer annular surfaces directed radially inwardly and radially outwardly respectively, and a ring section, said sections being assembled in a press-fit relationship to form a vacuum-tight joint between the frame section and the tubular window flange section with the material of the outer section having a thermal coefficient of expansion smaller than that of the window flange section, the tubular window flange section being disposed interiorly of the tubular frame section and terminating in an edge which is directed toward the exterior of the window structure, the ring section being disposed within the tubular window flange section, and the window flange section being of material having a thermal coefficient of expansion greater than that of the tubular frame section, the radially outer annular surface of the tubular window flange section mating with the radially inner annular surface of the tubular frame section, the ring section having an axially extending radially outer annular surface mating with the radially inner annular surface of the tubular window flange section, the ring section being encircled by both the tubular window flange section and the tubular frame section, and the tubular frame section, the tubular window flange section and the ring section being forced together with sufficient pressure therebetween at the mating surfaces thereof to provide a vacuum-tight mechanical press-fit relationship in the absence of any additional securing means.

2. A window structure according to claim 1 characterized in that the material of higher coefficient of thermal expansion forming the window flange section has the shape of a cap whose edge is bent so as to extend generally in an axial direction and toward the exterior of the window structure.

3. A window structure according to claim 1, characterized in that the frame tubular section and the ring section are made of steel of generally similar thermal coefficient of expansion, and that the window flange section is disposed between the frame tubular section and the ring section and is made of pure or alloyed aluminum having a greater thermal coefficient of expansion than the material of either the frame tubular section or the ring section.

4. A vacuum-tight window structure for the passage of X-ray energy and similar penetrating radiation, said structure comprising a frame having a tubular frame section with an edge directed generally axially toward the exterior side of the window construction, a window member having a window section transparent to penetrating radiation and having a tubular window flange section, and a ring section, said sections being assembled in a press-fit relationship to form a vacuum-tight joint between the frame section and the tubular window flange section with the material of the outer section having a thermal coefficient of expansion smaller than that of the window flange section, the tubular window flange section being disposed interiorly of the tubular frame section and terminating in an edge which is directed toward the exterior of the window structure, the ring section being disposed within the tubular window flange section, and the window flange section being of material having a thermal coefficient of expansion greater than that of the tubular frame section, the tubular frame section and the ring section being made of steel of generally similar thermal coefficient of expansion, and the window flange section being disposed between the tubular frame section and the ring section and being made of pure or alloyed aluminum having a greater thermal coefficient of expansion than the material of either the tubular frame section or the ring section, the interior ring section being provided with an exterior surface of conical shape and of progressively increasing diameter in the direction toward the exterior of the window structure, and the tubular frame section being provided with an interior surface of a substantially conical shape and with a progressively increasing diameter in the direction toward the exterior of the window structure.

5. A window structure according to claim 4 characterized in that at least one of the sections made of steel is provided with at least one bead extending about its circumference on that surface which is engaged with the aluminum material of the window flange section so as to mechanically interlock such one section with the window flange section when the sections are at a common temperature.

6. A window structure according to claim 5 characterized in that the bead is formed on the tubular frame section and has a triangular cross section, the peak of the triangular cross section being directed inwardly and terminating below the surface of the window flange section by an amount at room temperature sufficient to mechanically interlock the window flange section to the tubular frame section.

7. An electronic x-ray image intensifier comprising a tube having a tubular frame section with a radially inner annular surface, a cap-shaped window member having a central outwardly dished window section with an edge bent so as to extend generally in an axial direction toward the exterior of the tube and providing a tubular window flange section with radially inner and radially outer annular surfaces directed radially inwardly and radially outwardly respectively, and a ring section, said sections being assembled in a press-fit relationship to form a vacuum-tight joint between the frame section and the tubular window flange section with the material of the frame section having a thermal coefficient of expansion smaller than that of the window flange section, the tubular window flange section being disposed interiorly of the tubular frame section, the ring section being disposed within the tubular window flange section so as to be encircled by both the tubular window flange section and the tubular frame section, and having a thermal coefficient of expansion such that the pressure of the press-fit relationship increases with increasing temperature, the radially outer annular surface of the tubular window flange section mating with the radially inner annular surface of the tubular frame section, the radially outer annular surface of the ring section mating with the radially inner annular surface of the tubular window flange section, and the tubular frame section, the tubular window flange section and the ring section being forced together with sufficient pressure therebetween at the mating surfaces thereof to provide a vacuum-tight mechanical press-fit relationship in the absence of any additional securing means.

8. An image intensifier according to claim 7 with the radially outer annular surface of the tubular window flange section having mating engagement with the radially inner annular surface of the tubular frame section over an extent in the axial direction of about 2 to 3 centimeters.

9. An image intensifier according to claim 7 with the window member including said tubular window flange section being of sheet material having a thickness of about 1 millimeter.

10. An image intensifier according to claim 7 having an inlet diameter of about 30 centimeters, the ring section fitting substantially entirely within the tubular window flange section and having substantially greater radial thickness than the tubular window flange section, the radially outer annular surface of the tubular window flange section engaging the radially inner annular surface of the tubular frame section over an axial extent of from about 2 to 3 centimeters and sufficient to provide a vacuum-tight seal therebetween solely by virtue of the mechanical press-fit relationship therebetween.

* * * * *